United States Patent [19]

Emi et al.

[11] Patent Number: 4,784,909

[45] Date of Patent: Nov. 15, 1988

[54] ANTI-FUNGUS, DEODORANT FIBER MATERIAL

[75] Inventors: Shingo Emi, Daito; Tamio Mitamura, Kobe, both of Japan

[73] Assignee: Teijin Limited, Osaka, Japan

[21] Appl. No.: 97,155

[22] Filed: Sep. 16, 1987

[30] Foreign Application Priority Data

Sep. 16, 1986 [JP] Japan ..... 61-217774
Sep. 16, 1986 [JP] Japan ..... 61-217775
Sep. 16, 1986 [JP] Japan ..... 61-217776
Sep. 16, 1986 [JP] Japan ..... 61-217777

[51] Int. Cl.[4] ..... D02G 3/00

[52] U.S. Cl. ..... 428/357; 428/372; 428/373; 428/374; 428/379; 428/397; 428/399; 428/907

[58] Field of Search ..... 428/357, 372, 373, 374, 428/379, 397, 399, 364, 224, 907

[56] References Cited

U.S. PATENT DOCUMENTS 3,547,688 12/1970 Gagliardi et al. ..... 428/907 X
3,616,183 10/1971 Brayford et al. ..... 428/373
3,718,534 2/1973 Okamoto et al. ..... 428/374
3,959,556 5/1976 Morrison ..... 428/907 X
3,998,988 12/1976 Shimomai et al. ..... 428/372 X
4,010,308 3/1977 Wiczer ..... 428/398 X
4,343,853 8/1982 Morrison ..... 428/907 X
4,462,136 7/1984 Nakao et al. ..... 15/159 AX

*Primary Examiner*—Lorraine T. Kendell
*Attorney, Agent, or Firm*—Burgess Ryan & Wayne

[57] ABSTRACT

An anti-fungus, deodorant fiber material comprises synthetic polymer fibers, a deodorant material in an amount of 8% by weight or more and consisting of an ethylene-ethylenically unsaturated carboxylic acid copolymer, and an anti-fungus material in an amount of 1% by weight or more and consisting of fine copper particles preferably having a size of 50 mesh or smaller, and the deodorant material and the anti-fungus material are contained together in the synthetic fibers or the deodorant material is contained in one type of synthetic fibers and the anti-fungus material is separately contained in another type of synthetic fibers.

22 Claims, 1 Drawing Sheet

ANTI-FUNGUS, DEODORANT FIBER MATERIAL

BACKGROUND OF THE INVENTION

1. Field of the Invention

The present invention relates to an antifungus, deodorant fiber material. More particularly, the present invention relates to an anti-fungus, deodorant fiber material having an enhanced anti-fungus and deodorant property and improved durability, especially a resistance to washing.

2. Description of the Related Art

Various offensive odors are generated in day-to-day life and are directly or indirectly unpleasant or harmful.

The offensive odors are caused by nitrogen compounds, for example, ammonia and amine compounds, sulfur compounds, for example, hydrogen sulfide and mercaptan compounds; aldehyde compounds, ketone compounds, fatty acids, and hydrocarbons.

Under the Offensive Odor Prevention Law of Japan, ammonia, methyl mercaptan, hydrogen sulfide, methyl sulfide, trimethylamine, acetaldehyde, styrene, and methyl disulfide are designated as offensive odorous substances and are specifically regulated.

Various absorbing materials are utilized to eliminate the offensive odors and the offensive odor-generating substances. In organic absorbing materials, for example, activated carbon, silica gel, zeolite, and activated china clay and organic absorbing materials, for example, ion-exchange resins, and liquid absorbing materials comprising, as a main component, an abstract from camellia plants, are used as an offensive odor-absorbing material. Also, polyethylene fibrous materials having cation-exchange radicals and/or anion-exchange radicals introduced into polymers located in the surface portion of the fibers are used as an offensive odor-absorbing material.

However, most of the conventional absorbing materials are effective only for specific offensive odors generated from specific substances. Also, some of the conventional offensive odor-absorbing materials have a poor fiber-forming property; i.e., even if the absorbing materials are formed into fibers, the resultant fibers have an offensive odor-absorbing area located only on the surfaces of the fibers, and therefore, exhibit a small absorbing capacity and a poor durability in use.

SUMMARY OF THE INVENTION

An object of the present invention is to provide an anti-fungus, deodorant fiber material having excellent deodorant and anti-fungus effects.

Another object of the present invention is to provide an anti-fungus, deodorant fiber material having an enhanced durability in use, especially a resistance to washing, and satisfactory mechanical properties.

Still another object of the present invention is to provide an anti-fungus, deodorant fiber material which can be produced with a high productivity.

The above-mentioned objects can be attained by the anti-fungus, deodorant fiber material of the present invention, which comprises synthetic fibers, 8% or more based on the weight of the fiber material, of a deodorant material consisting of at least one copolymer of ethylene with at least one type of comonomer selected from ethylenically unsaturated carboxylic acids and anhydrides thereof, and 1% or more, based on the weight of the fiber material, of and an anti-fungus material consisting of fine copper particles, the deodorant material and the anti-fungus material being contained together or separately from each other in the fibers.

DESCRIPTION OF THE PREFERRED EMBODIMENTS

Figure 1:
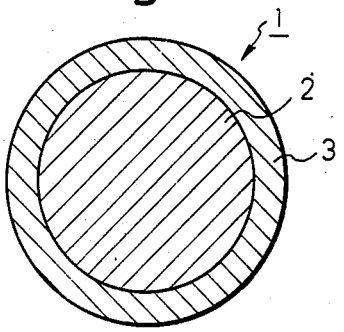
FIG. 1 shows a cross-section of an embodiment of the deodorant fiber of the present invention containing a deodorant material.

The anti-fungus, deodorant fiber material of the present invention comprises synthetic fibers containing a deodorant material and an anti-fungus material.

The deodorant material and the anti-fungus material are contained together in the synthetic fibers. Alternatively, the deodorant material and the anti-fungus material are contained separately from each other in the fibers so that the anti-fungus deodorant fiber material comprises a first type of fibers containing the deodorant material and a second type of fibers containing the anti-fungus material.

The deodorant material usable for the present invention consists of at least one direct copolymer of ethylene with at least one type of comonomer selected from ethylenically unsaturated carboxylic acids and anhydrides thereof. The deodorant material may be a mixture of at least one copolymer defined above with at least one fiber-forming polymer. The fiber-forming polymer is preferably selected from polyester, polyamide and polyolefin polymers.

The ethylenically unsaturated carboxylic acids usable for the present invention preferably have 3 to 15 carbon atoms and are preferably selected from the group consisting of acrylic acid, methacrylic acid, maleic acid, itaconic acid, citraconic acid, hymic acid, bi-cyclo(2,2,-2)octa-5-ene-2,3-dicarboxylic acid, 1,2,3,4,5,8,9,10-octahydronaphthalene-2,3-dicarboxylic acid, bi-cyclo(2,2,1)octa-7-ene-2,3,5,6-tetracarboxylic acid, and 7-oxa-bi-cyclo(2,2,1)hepta-5-ene-2,3-dicarboxylic acid.

More preferable ethylenically unsaturated carboxylic acids for the present invention are acrylic acid and methacrylic acid.

The copolymer can be prepared by directly copolymerizing ethylene with the ethylenically unsaturated carboxylic acid or anhydride thereof by a known addition polymerization method so that the resultant copolymer is provided with side chains containing at least one carboxyl radicals.

The direct copolymer of the ethylenically unsaturated carboxylic acid and ethylene preferably contains the carboxyl radicals in an amount of from 0.2 to 6 milli equivalent per gram of the copolymer, more preferably 0.3 to 5 milli equivalent/g, still more preferably 0.4 to 4 milli equivalent/g.

The deodorant material may be contained in a mixture of the copolymer with a fiber-forming polymer, for example, a polyolefin polymer. The polyolefin polymer enhances the deodorant property, mechanical strength and fiber-forming property of the deodorant material, and is preferably selected from low density polyethylenes, high density polyethylenes, polypropylenes, ethylene-propylene copolymers, polybutene-1, poly-4-methylpentene-1, and ethylene-vinyl acetate copolymers.

Preferably, in the mixture of the copolymer with the polyolefin polymer, the copolymer is in an amount of 100 parts by weight or less based on 100 parts by weight of the polyolefin polymer.

In the fiber material of the present invention, the deodorant copolymer is contained in an amount of 8% by weight or more, preferably from 10% to 80%, based on the weight of the fiber material.

If the content of the copolymer is less than 8% by weight, the resultant fiber material exhibits an unsatisfactory deodorant effect.

In the fiber material of the present invention, the anti-fungus material consists of fine copper particles contained in the synthetic fibers.

The fine copper particles preferably have a 50 mesh size or smaller, i.e., will pass through a 50 mesh screen. If the copper particles have a size larger than 50 mesh, it is difficult to evenly disperse the particles in the fibers and the resultant fiber material exhibits an unsatisfactory anti-fungus deodorant effect.

The fiber material of the present invention contains the fine copper particles in an amount of 1% or more, more preferably from 2% to 40%, based on the weight of the fiber material.

If the content of the fine copper particles is less than 1% by weight, the resultant fiber material exhibits an unsatisfactory deodorant, anti-fungus effect.

Usually, the fine copper particles are in the form of dispersoids dispersed in a matrix consisting of a thermoplastic polymer material.

The matrix thermoplastic polymer material for the fine copper particles comprises at least one selected from polyester, polyamide and polyolefin polymers, for example, high density polyethylenes, low density polyethylenes, polypropylenes, ethylene-propylene copolymer, poly-butene-1, poly-4-methylpentene-1, and ethylene-vinyl acetate copolymers.

Where the deodorant material is contained in the first type of fibers and the anti-fungus material is contained in the second type fibers other than the first type of fibers, the first fibers preferably comprise the deodorant material and a first thermoplastic polymer material, the second fibers preferably comprise the anti-fungus material and a second thermoplastic polymer material, and the first fibers and the second fibers should be evenly blended with each other.

Usually, the first fibers and the second fibers are blended in a ratio of from 90:10 to 50:50 by weight, preferably 85:15 to 60:40 by weight.

In the first fibers, the deodorant material and the first thermoplastic polymer are contained in a ratio of from 80:20 to 20:80.

The first thermoplastic polymer to be contained in the first fibers is preferably selected from polyester polymers, for example, polyethylene terephthalate polymers and polybutylene terephthalate polymers.

The most preferable first thermoplastic polymer is a polyester polymer having a melting temperature of 170° C. or more, for example, polyethylene terephthalate polymer.

In each of the first fibers, the deodorant material is contained therein in such a manner that at least one deodorant filamentary constituent consisting of the deodorant material and at least one support filamentary constituent consisting of the first thermoplastic polymer material extend substantially in parallel to the longitudinal axis of the first fiber and are bonded to each other to form a body of fiber, and the deodorant filamentary constituent forms at least one portion of the periphery of the first fiber.

The deodorant filamentary constituent and the support filamentary constituent may be in a core-in-sheath structure in which the core is formed by the support filamentary constituent and the sheath is formed by the deodorant filamentary constituent and covers the core, as indicated in FIG. 1.

Referring to FIG. 1, which shows a cross-sectional profile of a core-in-sheath type fiber 1, a core 2 consisting of the support filamentary constituent (the first thermoplastic polymer) is covered by a sheath 3 consisting of the deodorant filamentary constituent (deodorant material), and the core 2 and the sheath 3 are bonded to each other to form a fiber body. In the core-in-sheath type composite fiber 1, the entire periphery of the fiber is formed by the deodorant material sheath.

Figure 2:
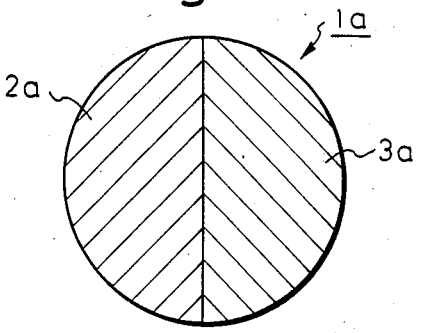
FIG. 2 shows a cross-section of another embodiment of the deodorant fiber of the present invention containing a deodorant material.

The first fiber usable for the present invention may have a bimetal structure as shown in FIG. 2.

Referring to FIG. 2, a composite fiber 1*a* is composed of a support filamentary constituent 2*a* consisting of a first thermoplastic polymer and a deodorant filamentary constituent 3*a* consisting of a deodorant material. The support and deodorant filamentary constituents 2*a* and 3*a* extend substantially in parallel to each other and to the longitudinal axis of the first fiber 1*a* and are bonded to each other in a side-by-side relationship. In this type of first fiber 1*a*, a half of the periphery of the fiber 1*a* is formed by the deodorant filamentary constituent 3*a*.

The first fiber may be composed of one or more support filamentary constituents and one or more deodorant constituents bonded to each other, as long as at least a portion of the peripheral surface of the first fiber is formed by the deodorant filamentary constituents.

The first fiber may have a circular regular cross-sectional profile or a non-circular irregular cross-sectional profile, for example, a tri-lobal cross-sectional profile, which provides an increased peripheral surface of the fibers.

In the fiber material of the present invention, the first fibers preferably contain the deodorant copolymer in an amount of 10% to 90%, more preferably, 20% to 80%, based on the weight of the first fibers.

The first fibers usable for the present invention can be produced by any known composite fiber-forming method.

In each second fiber the anti-fungus material is dispersed in a second thermoplastic polymer material.

The second thermoplastic polymer material comprises at least one member selected from polyolefin polymers, for example, polyethylene, polypropylene and ethylene-propylene copolymers.

A preferable second thermoplastic polymer material consists of a polyethylene.

In each second fiber the anti-fungus material comprising fine copper particles is preferably distributed in an amount of 5% by weight or more in at least the peripheral surface portions of the second fiber.

That is, the anti-fungus material may be evenly distributed throughout the second fiber or may be locally distributed in the peripheral surface portions of the second fiber.

Each second fiber containing the anti-fungus material preferably has an irregular non-circular cross-sectional profile, for example, a trilobal cross-sectional profile, which provides a relatively large peripheral surface area of the fiber. Also, preferably the second fiber is a thick-and-thin type of fiber having a cross-sectional area varying along the longitudinal axis thereof. This type of fiber has a relatively large peripheral surface area thereof.

Preferably, the copper particles in the second fiber have a 50 mesh size or smaller.

The second fibers usable for the present invention can be produced by known blended polymer fiber-forming methods.

Figure 3:
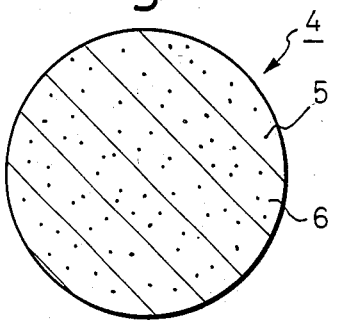
FIGS. 3 to 6 show cross-sections of embodiments of the deodorant, anti-fungus fiber of the present invention containing a deodorant material and an anti-fungus material.

The first and second fibers may contain conventional additives, such as pigments, for example, titanium dioxide, a flame-retardant, stabilizer, and a fluorescent brightening agent.

Where the deodorant material and the anti-fungus material are contained together in the synthetic fiber, the anti-fungus material comprising fine copper particles may be evenly dispersed in the deodorant material as shown in FIG. 3.

Referring to FIG. 3 showing in a cross-sectional profile of a fiber 4, a number of fine copper particles 5 are evenly dispersed in a matrix 6 consisting of the deodorant material.

In another embodiment, the deodorant, anti-fungus fiber is composed of at least one anti-fungus filamentary constituent containing the anti-fungus material dispersed in a matrix consisting of a thermoplastic polymer material and at least one deodorant filamentary constituent consisting essentially of the deodorant material. The anti-fungus and deodorant filamentary constituents extend substantially in parallel to the longitudinal axis of the fiber and are bonded to each other to form a body of a composite fiber, of which at least a portion of the peripheral surface is formed by the deodorant filamentary constituent.

Figure 4:
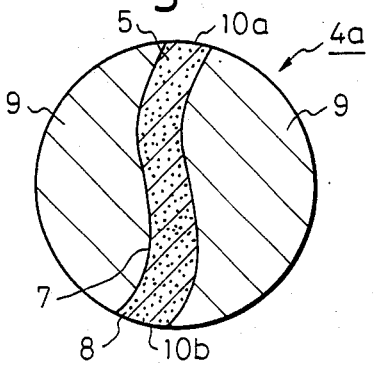

In an example shown in FIG. 4, a fiber **4*a* is composed of an anti-fungus filamentary constituent 7 consisting of a thermoplastic polymer matrix 8 and fine copper particles 5 dispersed in the matrix 8 and two deodorant filamentary constituents 9 consisting of the deodorant material. The anti-fungus and deodorant filamentary constituents 7 and 9 extend along the longitudinal axis of the fiber 4*a* and are bonded to each other in a three-layered structure to form a body of composite layer so that the side ends 10*a* and 10*b* of the anti-fungus filamentary constituent 7 are exposed to the outside of the fiber 4*a* and form portions of the peripheral surface of the fiber 4*a***.

In the composite fiber shown in FIG. 4, the deodorant filamentary constituents 9 and the anti-fungus filamentary constituent 7 are preferably in a weight ratio of 95:5 to 20:80, more preferably, 95:5 to 50:50.

Another type of composite fiber may be composed of one deodorant filamentary constituent and one anti-fungus filamentary constituent bonded to each other in a bimetal structure as shown in FIG. 2.

Figure 5:
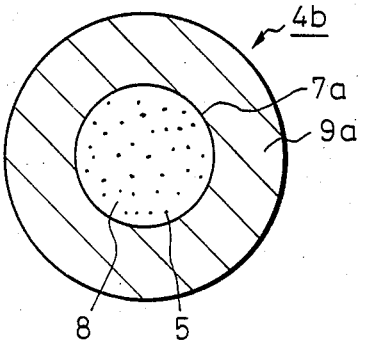

In a core-in-sheath type composite fiber **4*b* shown in FIG. 5, the core 7*a* is formed by an anti-fungus filamentary constituent comprising the fine copper particles 5 dispersed in a matrix 8 consisting of the thermoplastic polymer material and the sheath 9*a*** is formed by a deodorant filamentary constituent comprising the deodorant material.

Figure 6:
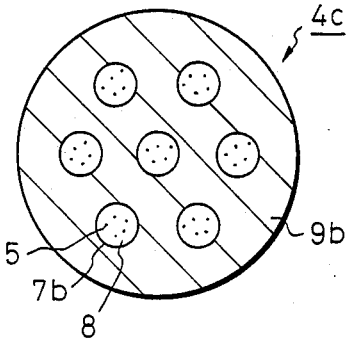

In an islands-in-sea type composite fiber **4*c* shown in FIG. 6, a plurality of islands 7*b* are formed by anti-fungus filamentary constituents comprising the fine copper particles 5 dispersed in a matrix 8 consisting of the thermoplastic polymer material and the sheath 9*b*** is formed by a deodorant filamentary constituent comprising the deodorant material.

In another example of the composite fiber (not shown in the drawings), the anti-fungus material is dispersed in both the deodorant and anti-fungus filamentary constituents.

In still another example of the composite fiber (not shown in the drawings), both the anti-fungus material and the deodorant material are contained in at least one filamentary constituent and the remaining at least one filamentary constituent is free from the anti-fungus material and the deodorant material. In this example, however, at least a portion of the peripheral surface of the composite fiber should be formed by the filamentary constituent containing the anti-fungus and deodorant materials.

The composite fiber containing both the deodorant material and the anti-fungus material may have a circular cross-sectional profile or an irregular non-circular cross-sectional profile having a ratio D/d of 1.1 or more, wherein D represents a diameter of a circumcircle of the cross-sectional profile and d represents a diameter of an inscribed circle of the cross-sectional profile.

The polymer-blend fibers or composite fibers containing both the deodorant material and the anti-fungus material can be produced by any known fiber-forming method. For example, usual orifice type melt-spinning methods, burst fiber-forming methods in which a gas is dissolved in a polymer melt and the dissolved gas-containing polymer melt is extruded through a slit of die to form net-shaped fibers, or the fiber-forming method disclosed in Japanese Unexamined Patent Publication No. 58-91804 can be applied to the production of the fiber usable for the present invention.

In the fiber-forming method disclosed in the above-mentioned Japanese publication, a deodorant material is melted in a first extruder and is extruded through a die of the first extruder; a thermoplastic polymer material blended with the anti-fungus material (the fine copper particles) is melted in a second extruder and is extruded through a die of the second extruder; at least one stream of the extruded deodorant material melt and at least one stream of the extruded anti-fungus material-containing thermoplastic material melt are introduced into a static mixer (for example, a Kenics type static mixer) and are incorporated to provide a composite stream of the above-mentioned melts in the static mixer; and the composite stream is extruded through an I type die. The resultant composite filament bundle is drawn at a draw ratio of, for example, 1.2 to 2.0, and the drawn filaments are crimped by a crimping machine or heat-crimping device.

The mixing operation of the deodorant material melt with the anti-fungus material-containing polymer melt and the thickness (denier) of the resultant composite fibers can be easily controlled by adjusting the number of static mixer elements to an appropriate level and by controlling the size of a mesh-like metal net used as a thick and thin fiber-spinning orifice and the draw ratio to appropriate levels.

The mesh-like metal net is formed by a metallic material which will produce heat when an electric current is applied thereto.

However, it should be noted the method for producing the composite fibers usable for the present invention is not limited to the above-described methods.

The fiber containing the deodorant material and the anti-fungus material preferably have a non-circular cross-sectional profile having a ratio D/d (irregularity coefficient) of 1.1 or more. Preferably the ratio D/d and the thickness (cross-sectional area) of the fibers irregularly vary along the longitudinal axis thereof.

The fiber material of the present invention, the deodorant, anti-fungus fibers, are preferably in the form of short cut fibers having a length of 20 to 100 mm and a crimp number of 5 crimps/25 mm to 25 crimps/25 mm.

The fiber material of the present invention may be in the form of a spun yarn consisting of the short cut deodorant, anti-fungus fibers or a multifilament yarn consisting of deodorant, anti-fungus multifilaments.

Also, the fiber material of the present invention may be in the form of a woven fabric, knitted fabric, or a nonwoven fabric comprising the deodorant, anti-fungus short cut fibers or multifilaments.

The fiber material of the present invention preferably consists of the deodorant anti-fungus fibers only.

However, the fiber material of the present invention may contain additional fibers, for example, cotton, wool, viscose rayon, cellulose acetate fibers, polyamide fibers, polyester fibers, polyacrylic fibers, and polyolefin fibers, in addition to the deodorant, anti-fungus fibers.

In the additional fiber-containing fiber material of the present invention, the ethylene-ethylenically unsaturated carboxylic acid copolymer must be in a content of 8% or more based on the entire weight of the fiber material and the copper particles must be in a content of 1% or more based on the entire weight of the fiber material.

The fiber material of the present invention has an excellent deodorant effect on various offensive odors, satisfactory mechanical properties, processability, and durability, and an anti-fungus or germicidal effect. Therefore, the deodorant, anti-fungus fiber material of the present invention is useful for various medical and hygienic materials, for example, sanitary napkins and paper diapers, various types of filter materials, fillings in thick bedquilts or bedclothes, waddings, felt materials, blankets, carpet substrates, interior materials in buildings or cars, insoles of shoes, lining materials, mats for pets, deodorant materials for refrigerators, brassieres, girdles, body suits, pad materials, for example, bust pads, hip pads, and side pads, and sleeping wear.

The deodorant, anti-fungus effect of the fiber material of the present invention has an excellent resistance to washing and dry cleaning. Also, the fiber material of the present invention can discharge the absorbed offensive odor of, for example, ammonia, trimethylamine, or n-butyric acid, by washing and drying.

Accordingly, the deodorant, anti-fungus fiber material can be repeatedly used over a long period of time without decreasing the deodorant, anti-fungus effect thereof.

The fiber material of the present invention exhibits an excellent deodorant effect and a superior anti-fungus effect, because the above-mentioned effects are derived from chemical deodorant and anti-fungus actions of the specific ethylene-ethylenically unsaturated carboxylic acid copolymer and the fine copper particles, not from physical odor-absorbing actions thereof, and the fiber material is in the form of a number of fine fibers having a large peripheral surface area which exhibits the deodorant, anti-fungus actions.

Due to the usage of both the specific ethylene-ethylenically unsaturated carboxylic acid copolymer and the fine copper particles, the fiber material of the present invention can eliminate offensive odors derived from nitrogen compounds, for example, ammonia and trimethylamine, and aliphatic fatty acid compounds, for example, n-butyric acid, which are eliminated mainly by the ethylene-ethylenically unsaturated carboxylic acid copolymer, from sulfur compounds, for example, hydrogen sulfide and methylmercaptan, and from other substances.

The fiber-forming property of the ethylene-ethylenically unsaturated carboxylic acid copolymer can be improved by using another fiber-forming polymer, for example, polyethylene terephthalate polymer, as a co-operator.

Also, the copolymer is effective as a binder and can be firmly bonded with another polymer.

The fine copper powder exhibits a germicidal or bactericidal action and prevents or restricts the propagation of offensive odor-generating bacteria.

The present invention will be further illustrated by the following examples.

In the examples, the degree of deodorant effect was evaluated in the following manner.

A desiccator having a capacity of 4 liters was charged with 10 g of a deodorant material, and the pressure in the desiccator was reduced. A predetermined amount of a testing gas or liquid was introduced into the desiccator. The pressure in the desiccator was then returned to the same level as the ambient atmospheric pressure.

At this stage, the content of the testing gas in the desiccator was represented as an initial concentration thereof. The initial concentration of the testing gas in the desiccator was adjusted to a level of 200 to 300 ppm.

The desiccator was then left at the ambient atmospheric temperature for 3 hours, and subsequently, the concentration of the testing gas was measured. This concentration is represented as a final concentration of the testing gas in the desiccator. The degree of deodorant effect was calculated in accordance with the following equation:

$$\text{Degree of Deodorant Effect (\%)} = \frac{(\text{Initial concentration} - \text{final concentration})}{\text{Initial concentration}} \times 100$$

EXAMPLES 1 TO 3 AND COMPARATIVE EXAMPLES 1 AND 2

In each of Examples 1 to 3 and Comparative Examples 1 and 2, bimetal type composite fibers were produced by a known bimetal type composite filament melt-spinning apparatus as disclosed in Japanese Unexamined Patent Publication No. 58-70712, from ethylene-acrylic acid copolymer chips (Trademark: Yukalon EAA A 201M, made by Mitsubishi Yuka Co.) and blend chips of a polypropylene (Trademark: S-115M, made by Ube Industries, Ltd.) with fine copper particles having a 50 mesh size or smaller in the amount shown in Table 1.

The ethylene-acrylic acid copolymer chips were melted and extruded at a predetermined extruding rate at a temperature of 210° C. to 250° C. by an extruder, and separately, the polypropylene blend chips containing the copper particles were melted and extruded at a predetermined extruding rate at a temperature of 220° C. to 260° C. by another extruder.

The extruded copolymer melt and blend melt were incorporated and introduced into an adaptor connected to the above-mentioned two extruders having a Kenics type static mixer having 8 elements, at a temperature of 250° C. The resultant composite streams of the melts were extruded through an uneven spinneret consisting of a 60 mesh plain weave metallic net. The extruded melt streams were cooled and solidified by blowing cooling air thereto, and the solidified composite filaments were taken up at a speed of 6 m/min.

The temperature of the spinneret was controlled at a predetermined level by applying an electric current of about 50 A to the metallic net to generate Joule heat.

The resultant bimetal type composite filaments were drawn at a draw ratio of 1.3 to 2.5 on a drawing plate controlled at a temperature of 85° C.

In the resultant individual composite filament, a filamentary constituent consisting of the ethyleneacrylic acid copolymer and another filamentary constituent consisting of a polypropylene-copper particle blend extended along the longitudinal axis of the composite filaments were bonded to each other to the form of a bimetal. Therefore, a portion of the peripheral surface of each composite filament was formed by the ethylene-acrylic acid copolymer filamentary constituent.

The composite filaments had an irregular cross-sectional profile which had a ratio D/d of 1.4 or more. Also, the cross-sectional area and the ratio D/d varied along the longitudinal axis of the composite filament.

The drawn composite filaments were cut into a length of 95 mm and the resultant composite fibers were heat-treated at a temperature of 100° C. for 10 minutes to generate cubic crimps on the fibers.

The degree of deodorant effect of the fibers is shown in Table 1.

TABLE 1

| Item | Comparative Example 1 | Example 1 | Example 2 | Comparative Example 2 | Example 3 |
|---|---|---|---|---|---|
| Content of ethylene-acrylic acid copolymer (% by weight) | 7 | 10 | 50 | 50 | 50 |
| Content of fine copper particles (% by weight) | 40 | 40 | 40 | 0.8 | 1.2 |
| Property of fiber | | | | | |
| Thickness (denier) | 12 | 11 | 10 | 11 | 12 |
| Tensile strength (g/d) | 2.5 | 2.3 | 1.5 | 1.3 | 1.3 |
| Ultimate elongation (%) | 85 | 80 | 50 | 70 | 65 |
| Degree of deodorant effect | | | | | |
| Ammonia | 30 | 60 | 100 | 100 | 100 |
| Trimethylamine | 25 | 50 | 90 | 90 | 90 |
| Hydrogen sulfide | 100 | 100 | 100 | 35 | 80 |
| Methyl mercaptan | 100 | 100 | 100 | 15 | 65 |
| n-Butyric acid | 20 | 45 | 85 | 85 | 85 |

The deodorant, anti-fungus composite fibers of Example 2 were subjected to a germicidal test wherein the composite fibers were brought into contact with a physiological saline containing colibacillus and staphylococcus, at room temperatrue. The number of bacteria in the physiological saline was measured before the test and 2 hours afer the contact with the bacteria.

The results are shown in Table 2.

TABLE 2

| Item | Number of bacteria: Before test | Number of bacteria: 2 hours after contact with bacteria |
|---|---|---|
| Colibacillus | $3 \times 10^4$ | 30 |
| Staphylococcus | $1 \times 10^3$ | 80 |

During the above-mentioned test, there was no generation of block mold and trichophyton on the composite fibers.

The above-mentioned composite fibers were opened into the form of a web by a carding machine and heat-treated with hot air at a temperature of 150° C. The resultant web had a weight of 250 g/m$^2$.

The web exhibited the same deodorant effects as those indicated in Table 1 and the same germicidal effects as those indicated in Table 2.

EXAMPLES 4 TO 6 AND COMPARATIVE EXAMPLES 3 AND 4

A core-in-sheath type composite fiber was produced in each of Examples 4 to 6 and Comparative Examples 3 and 4 from a core constituent consisting of the same ethylene-acrylic acid copolymer as that mentioned in Example 1, and a sheath constituent consisting of the same polypropylene blend containing the copper particles as that described in Example 1. Use was made of an extruder for a core-in-sheath type composite fiber, a spinneret having 15 spinning holes having a diameter of 0.3 mm, and a take up speed of 500 m/min.

The contents of the ethylene-acrylic acid copolymer and the copper particles in the composite fibers were as indicated in Table 3.

The undrawn filament yarn was drawn at a draw ratio of 1.3 to 2.5 in hot water at a temperature of 70° C.

The drawn filament yarn was crimped and cut in the same manner as mentioned in Example 1.

The properties and deodorant effect of the resultant composite fibers in each of the examples and comparative examples are shown in Table 3.

TABLE 3

| Item | Comparative Example 3 | Example 4 | Example 5 | Comparative Example 4 | Example 6 |
|---|---|---|---|---|---|
| Content of ethylene-acrylic acid copolymer (% by weight) | 7 | 10 | 50 | 50 | 50 |

TABLE 3-continued

| Item | Comparative Example 3 | Example 4 | Example 5 | Comparative Example 4 | Example 6 |
|---|---|---|---|---|---|
| Content of copper particles (% by weight) | 40 | 40 | 40 | 0.8 | 1.2 |
| Property of composite fiber | | | | | |
| Thickness (d) | 6 | 6 | 8 | 8 | 8 |
| Tensile strength (g/d) | 2.2 | 2.0 | 1.5 | 1.5 | 1.5 |
| Ultimate elongation (%) | 100 | 90 | 65 | 70 | 70 |
| Deodorant effect (%) | | | | | |
| Ammonia | 35 | 65 | 100 | 100 | 100 |
| Trimethylamine | 30 | 55 | 95 | 95 | 95 |
| Hydrogen sulfide | 90 | 90 | 90 | 15 | 65 |
| Methyl mercaptan | 85 | 85 | 85 | 10 | 55 |
| n-Butyric acid | 25 | 50 | 90 | 90 | 90 |

The composite fibers in Example 5 were subjected to the same anti-fungus test as mentioned in Example 1.

The results are shown in Table 4.

TABLE 4

| Item | Number of bacteria | |
|---|---|---|
| | Before test | 2 hours after contact with bacteria |
| Colibacillus | $5 \times 10^4$ | 5 |
| Staphylococcus | $3 \times 10^4$ | 30 |

During the test, there was no generation of black mold and trichophyton.

EXAMPLES 7 TO 9 AND COMPARATIVE EXAMPLES 5 AND 6

In each of Examples 7 to 9 and Comparative Examples 5 and 6, the same procedures for producing the drawn bimetal type composite filament yarn as those described in Example 1 were carried out.

The resultant drawn composite filaments were cut to a length of 51 mm and the resultant short cut fibers were subjected to hot air treatment at a temperature of 90° C. for 5 minutes to generate cubic crimps on the fibers at a crimp number of 10 crimps/25 mm.

The crimped short cut composite fibers were blended with polyethylene terephthalate short cut fibers having a thickness of 4 denier, a length of 64 mm, and a crimp number of 13 crimps/25 mm so that the resultant blend contained the ethylene-acrylic acid copolymer and the fine copper particles in the contents shown in Table 5.

The blend was converted to a spun yarn having a yarn number count of 20.

The deodorant effects of the resultant spun yarns are indicated in Table 5.

TABLE 5

| Item | Comparative Example 5 | Example 7 | Example 8 | Comparative Example 6 | Example 9 |
|---|---|---|---|---|---|
| Content of ethylene-acrylic acid copolymer (% by weight) | 7 | 10 | 50 | 50 | 50 |
| Content of fine copper particles (% by weight) | 40 | 40 | 40 | 0.8 | 1.2 |
| Deodorant effect | | | | | |
| Ammonia | 30 | 60 | 100 | 100 | 100 |
| Trimethylamine | 25 | 50 | 90 | 90 | 90 |
| Hydrogen sulfide | 100 | 100 | 100 | 35 | 80 |
| Methyl mercaptan | 100 | 100 | 100 | 15 | 65 |
| n-Butyric acid | 20 | 45 | 85 | 85 | 85 |

EXAMPLES 10 TO 12 AND COMPARATIVE EXAMPLES 7 AND 8

In each of Examples 10 to 12 and Comparative Examples 7 and 8, the same procedures for producing the drawn core-in-sheath type composite filament yarn as described in Example 1 were carried out.

The resultant composite filament yarn was crimped and then cut. The resultant short cut fibers had a length of 51 m and a crimp number of 12 crimps/25 mm.

The short cut fibers were blended with viscose rayon short cut fibers having a thickness of 2 denier, a length of 51 mm, and a crimp number of 10 crimps/25 mm so that the resultant blend contained the ethylene acrylic acid copolymer and the fine copper particles in the contents shown in Table 6.

The blend was converted to a spun yarn having a yarn number count of 20.

The deodorant effects of the resultant spun yarns are shown in Table 6.

TABLE 6

| Item | Comparative Example 7 | Example 10 | Example 11 | Comparative Example 8 | Example 12 |
|---|---|---|---|---|---|
| Content of ethylene-acrylic acid copolymer (% by weight) | 7 | 10 | 50 | 50 | 50 |
| Content of fine copper particles (% by weight) | 40 | 40 | 40 | 0.8 | 1.2 |
| Deodorant effect | | | | | |
| Ammonia | 35 | 65 | 100 | 100 | 100 |
| Trimethylamine | 30 | 55 | 95 | 95 | 95 |

TABLE 6-continued

| Item | Comparative Example 7 | Example 10 | Example 11 | Comparative Example 8 | Example 12 |
|---|---|---|---|---|---|
| Hydrogen sulfide | 90 | 90 | 90 | 15 | 65 |
| Methyl mercaptan | 85 | 85 | 85 | 10 | 55 |
| n-Butyric acid | 25 | 50 | 90 | 90 | 90 |

EXAMPLES 13 TO 15 AND COMPARATIVE EXAMPLE 9

In each of Examples 13 to 15 and Comparative Example 9, the same procedures for producing the drawn bimetal type composite filament yarn as described in Example 1 were carried out except that, in the bimetal type composite filament melt-spinning apparatus, the ethylene-acrylic acid copolymer was extruded by an extruder at a extruding rate of 300 g/min and, in place of the polyethylene-copper particles mixture, a polyethylene (Trademark: S-115M, made by Ube Industries, Ltd.) was extruded by another extruder at a extruding rate of 75 g/min. The resultant ethylene-acrylic acid copolymer-containing composite filaments each had an average thickness of 12 denier, a tensile strength at 1.2 g/d, an ultimate elongation of 50° C., and a ratio D/d of about 1.4.

Additionally, in another bimetal type composite filament melt-spinning apparatus, polymer chips consisting of a mixture of 40 parts by weight of electrolytic copper particles having a 300 mesh size or smaller with 60 parts by weight of a polypropylene (Trademark: S-115M, made by Ube Industries, Ltd.) were melted and extruded by an extruder at an extruding rate of 240 g/min, polyethylene chips (Trademark: Noblen MK-40, made by Mitsubishi Kasei Kogyo K.K.) were melted and extruded by another extruder at an extruding rate of 60 g/min, and the melted mixture and polyethylene were incorporated and melt spun in the same manner as mentioned in Example 1.

The resultant copper particle-containing composite filaments were drawn at a draw ratio of 2.0 on a heating plate controlled to a temperature of 120° C. The resultant drawn composite filaments each had an average thickness of 6.8 denier, a tensile strength of 1.5 g/d, and an ultimate elongation of 45%. The drawn composite filaments were cut to a length of 51 mm and heat-treated by hot air at a temperature of 100° C. to generate cubic crimps on the fibers.

The short cut ethylene-acrylic acid copolymer-containing composite fibers and the short cut copper particle-containing composite fibers were blended with short cut polyethylene terephthalate fibers having a thickness of 6 denier and a length of 51 mm so that the resultant blend contained the ethylene-acrylic acid copolymer and the copper particles in the contents indicated in Table 7.

The blend was converted to a spun yarn having a yarn number count of 20 by an ordinary short cotton spinning method.

The deodorant effects of the resultant spun yarns are indicated in Table 7.

TABLE 7

| Item | Example 13 | Example 14 | Example 15 | Comparative Example 9 |
|---|---|---|---|---|
| Content of ethylene-acrylic acid copolymer (% by weight) | 30 | 50 | 50 | 7 |
| Content of fine copper particles (% by weight) | 20 | 20 | 1.2 | 0.8 |
| Deodorant effect | | | | |
| Ammonia | 90 | 100 | 100 | 35 |
| Trimethylamine | 80 | 90 | 90 | 30 |
| Hydrogen sulfide | 100 | 100 | 100 | 15 |
| Methyl mercaptan | 100 | 100 | 100 | 10 |
| n-Butyric acid | 70 | 85 | 85 | 25 |

EXAMPLES 16 TO 19

In each of Examples 16 to 19, core-in-sheath type composite filaments were produced from 60 parts by weight of a core constituent consisting of a polyethylene terephthalate made by Teijin Ltd. and having an intrinsic viscosity of 0.64 and 40 parts by weight of a sheath constituent consisting of an ethylene-acrylic acid copolymer (Trademark: Yukalon EAA XA 211 S1, made by Mitsubishi Yuka Co.) by an ordinary core-in-sheath type composite filament-melt spinning apparatus having 20 spinning holes at a take-up speed of 1000 m/min. The polyethylene terephthalate core constituent was melted at a temperature of 270° C. to 295° C. Also, the ethylene-acrylic acid copolymer sheath constituent was melted at a temperature of 210° C. to 250° C.

The taken-up composite filaments were drawn at a draw ratio of 3.0 in hot water at a temperature of 75° C. The drawn composite filaments were crimped by an ordinary crimping machine and then cut to a length of 51 mm. The resultant ethylene-acrylic copolymer-containing short cut composite fibers had an average thickness of 6.0 denier, a tensile strength of 3.2 g/d, and an ultimate elongation of 40%.

The same procedures for producing the copper particle-containing bimetal type composite short fibers as those described in Example 13 were carried out, with the exception that the polyethylene chips were replaced by polypropylene chips (Trademark: S-115M, made by Ube Industries, Ltd.).

The undrawn bimetal type composite filaments were drawn at a draw ratio of 2.5 on a heating plate at a temperature of 120° C. The drawn composite filaments were crimped by an ordinary stuffing box type crimping machine, and then cut to a length of 51 mm. The resultant copper particle-containing short cut composite fibers had an average thickness of 7.0 denier, a tensile strength of 1.8 g/d, and an ultimate elongation of 45%.

The above-described ethylene-acrylic acid copolymer-containing composite fibers and the copper particle-containing composite fibers were blended with polyethylene terephthalate short cut fibers having a thickness of 6.0 denier and a length of 51 mm so that the resultant blend contained the ethylene-acrylic acid copolymer and the copper particles in the contents indicated in Table 8. The blend was converted to a spun yarn having a yarn number count of 20 by an ordinary short cotton-spinning machine.

The resultant spun yarn exhibited the deodorant effects shown in Table 8.

TABLE 8

| Item | Example 16 | Example 17 | Example 18 | Example 19 |
|---|---|---|---|---|
| Content of ethylene-acrylic acid copolymer (% by weight) | 40 | 18 | 20 | 20 |
| Content of fine copper particles (% by weight) | 6.4 | 20.5 | 18.8 | 4.3 |
| Deodorant effect | | | | |
| Ammonia | 96 | 80 | 83 | 83 |
| Trimethylamine | 90 | 75 | 78 | 78 |
| Hydrogen sulfide | 92 | 100 | 100 | 90 |
| Methyl mercaptan | 88 | 100 | 100 | 85 |
| n-Butyric acid | 85 | 68 | 70 | 70 |

The spun yarn of Example 17 was subjected to the germicidal test as desribed in Example 1. The results were as shown in Table 9.

TABLE 9

| Item | Number of bacteria: Before test | Number of bacteria: 2 hours after start of test |
|---|---|---|
| Colibacillus | $6 \times 10^4$ | 50 |
| Staphylococcus | $8 \times 10^4$ | 110 |

During the test, there was no black mold and trichophyton found on the spun yarn.

EXAMPLES 20 TO 22 AND COMPARATIVE EXAMPLES 10 AND 11

In each of Examples 20 to 22 and Comparative Examples 10 and 11, the same procedures for producing the drawn bimetal type composite filament yarn as those described in Example 1 were carried out.

The resultant drawn composite filament yarns were knitted together with false-twisted polyethylene terephthalate multifiliament textured yarns to provide knitted fabrics each having a weight of 200 g/m$^2$ and each containing the ethylene-acrylic acid copolymer and the copper particles in the contents indicated in Table 10.

The resultant knitted fabrics exhibited the deodorant effects indicated in Table 10.

TABLE 10

| Item | Comparative Example 10 | Example 20 | Example 21 | Comparative Example 11 | Example 22 |
|---|---|---|---|---|---|
| Content of ethylene-acrylic acid copolymer (% by weight) | 7 | 10 | 50 | 50 | 50 |
| Content of fine copper particles (% by weight) | 40 | 40 | 40 | 0.8 | 1.2 |
| Deodorant effect | | | | | |
| Ammonia | 30 | 60 | 100 | 100 | 100 |
| Trimethylamine | 25 | 50 | 90 | 90 | 90 |
| Hydrogen sulfide | 100 | 100 | 100 | 35 | 80 |
| Methyl mercaptan | 100 | 100 | 100 | 15 | 65 |
| n-Butyric acid | 20 | 45 | 85 | 85 | 85 |

EXAMPLES 23 TO 25 AND COMPARATIVE EXAMPLES 12 AND 13

In each of Examples 23 to 25 and Comparative Examples 12 and 13, the same procedures for producing the drawn core-in-sheath type composite filaments as described in Example 1 were carried out.

The resultant drawn composite filaments were crimped at a crimp number of 12 crimps/25 mm by an ordinary crimping machine and were cut to a length of 51 mm. The resultant short cut fibers in an amount of 50 parts by weight were blended with 50 parts by weight of viscose rayon short cut fibers having a thickness of 2 denier, a length of 51 mm, and a crimp number of 12 crimps/25 mm. The blend was converted to a spun yarn having a yarn number count of 30.

The spun yarn was converted, together with a polyethylene terephthalate spun yarn having a yarn number count of 30, to a union twill fabric, so that the resultant union fabric contained the ethylene-acrylic acid copolymer and the copper particles in the contents indicated in Table 11.

The resultant union fabric exhibited the deodorant effects shown in Table 11.

TABLE 11

| Item | Comparative Example 12 | Example 23 | Example 24 | Comparative Example 13 | Example 25 |
|---|---|---|---|---|---|
| Content of ethylene-acrylic acid copolymer (% by weight) | 7 | 10 | 50 | 50 | 50 |
| Content of fine copper particles (% by weight) | 40 | 40 | 40 | 0.8 | 1.2 |
| Deodorant effect | | | | | |
| Ammonia | 35 | 65 | 100 | 100 | 100 |
| Trimethylamine | 30 | 55 | 95 | 95 | 95 |
| Hydrogen sulfide | 90 | 90 | 90 | 15 | 65 |
| Methyl mercaptan | 85 | 85 | 85 | 10 | 55 |
| n-Butyric acid | 25 | 50 | 90 | 90 | 90 |

EXAMPLES 26 TO 29

In Examples 26 to 29, the same procedures as those respectively described in Examples 16 to 19 were carried out except that two or more of the blend spun yarns containing the ethylene-acrylic acid copolymer-containing core-in-sheath type composite fibers, the copper particle-containing bimetal-type composite fibers, and the polyethylene terephthalate fibers were used together to produce a union plain weave having a weight of 180 g/m$^2$ and containing the ethylene-acrylic acid copolymer and the copper particles in the contents indicated in Table 12.

The resultant union weave exhibited the deodorant effects shown in Table 12.

TABLE 12

| Item | Example 26 | Example 27 | Example 28 | Example 29 |
|---|---|---|---|---|
| Content of ethylene-acrylic acid copolymer (% by weight) | 40 | 20 | 15 | 22.5 |
| Content of fine copper particles (% by weight) | 6.4 | 18.8 | 22.4 | 4.8 |
| Deodorant effect | | | | |
| Ammonia | 95 | 81 | 75 | 89 |
| Trimethylamine | 90 | 76 | 65 | 87 |
| Hydrogen sulfide | 93 | 100 | 100 | 85 |
| Methyl mercaptan | 88 | 100 | 100 | 80 |
| n-Butyric acid | 86 | 68 | 65 | 80 |

The union plan weave of Example 27 was subjected to the germicidal test as described in Example 1.

The results are shown in Table 13.

TABLE 13

| Item | Number of bacteria | |
|---|---|---|
| | Before test | 2 hours after |
| Colibacillus | $3 \times 10^4$ | 28 |
| Staphylococcus | $4 \times 10^4$ | 80 |

During the test, there ws no black mold and trichophyton found on the plain weave.

EXAMPLES 30 TO 32 AND COMPARATIVE EXAMPLES 14 AND 15

In Examples 30 to 32 and Comparative Examples 14 and 15, the same procedures for producing the drawn composite filaments as those respectively described in Examples 4 to 6 and Comparative Examples 3 and 4 were carried out.

The resultant drawn composite filaments were crimped at a crimp number of 12 crimps/25 mm by an ordinary gear-crimping machine and then were cut to a length of 51 mm.

One or more types of the resultant short cut composite fibers were blended with polyethylene terephthalate short cut fibers having a thickness of 4 denier, a length of 76 m, and a crimp number of 18 crimps/25 mm, so that the resultant blend contained the ethylene-acrylic copolymer and the copper particles in the contents indicated in Table 14.

The blend was converted to a web by a carding machine. The web was heat-treated with hot air at a temperature of 150° C.

The heat-treated web had a weight of 200 g/m$^2$.

The resultant webs exhibited the deodorant effects indicated in Table 14.

TABLE 14

| Item | Comparative Example 14 | Example 30 | Example 31 | Comparative Example 15 | Example 32 |
|---|---|---|---|---|---|
| Content of ethylene-acrylic acid copolymer (% by weight) | 7 | 10 | 50 | 50 | 50 |
| Content of fine copper particles (% by weight) | 40 | 40 | 40 | 0.8 | 1.2 |
| Deodorant effect | | | | | |
| Ammonia | 35 | 65 | 100 | 100 | 100 |
| Trimethylamine | 30 | 55 | 95 | 95 | 95 |
| Hydrogen sulfide | 90 | 90 | 90 | 15 | 65 |
| Methyl mercaptan | 85 | 85 | 85 | 10 | 55 |
| n-Butyric acid | 25 | 45 | 90 | 90 | 90 |

EXAMPLES 33 to 36

In Examples 33 to 36, the same procedures as those respectively described in Examples 16 to 19 were carried out except that the ethylene-acrylic acid-containing core-in-sheath type composite fibers, the cooper particle-containing bimetal type composite fibers, and the polyethylene terrephthalate fibers were blended together so that the resultant blend contained the ethylene-acrylic acid copolymer and the copper particles in the content indicated in Table 15.

The blend was connected to a web having a weight of 200 g/m$^2$ by an ordinary carding machine.

The resultant web exhibited the deodorant effects shown in Table 15.

TABLE 15

| Item | Example 33 | Example 34 | Example 35 | Example 36 |
|---|---|---|---|---|
| Content of ethylene-acrylic acid copolymer (% by weight) | 37.5 | 20 | 10 | 22.5 |
| Content of fine copper particles (% by weight) | 8 | 19.2 | 25.6 | 4.8 |
| Deodorant effect | | | | |
| Ammonia | 95 | 85 | 75 | 90 |
| Trimethylamine | 90 | 80 | 65 | 88 |
| Hydrogen sulfide | 90 | 100 | 100 | 85 |
| Methyl mercaptan | 85 | 100 | 100 | 80 |
| n-Butyric acid | 85 | 70 | 65 | 80 |

The web of Example 34 exhibited the germicidal effects as indicated in Table 16.

TABLE 16

| Item | Number of bacteria | |
|---|---|---|
| | Before test | 2 hours after |
| Colibacillus | $5 \times 10^4$ | 40 |
| Staphylococcus | $3 \times 10^4$ | 90 |

During the test, there was no black mold and trichophyton generated on the web.

We claim:

1. An anti-fungus, deodorant fiber material comprised of:

(a) a first fiber comprised of a first thermoplastic polymer containing at least 8% based on the weight of said fiber material, of a deodorant material and (b) a second fiber comprised of a second thermoplastic polymer containing at least 1% based on the weight of said fiber material, of fine copper particles, said first nd second syntheitc fibers being evenly blended with each other.

2. The fiber material as claimed in claim 1, wherein said ethylenically unsaturated carboxylic acid has 3 to 15 carbon atoms.

3. The fiber material as claimed in claim 1, wherein said ethylenically unsaturated carboxylic acid is selected from the group consisting of acrylic acid, methacrylic acid, maleic acid, itaconic acid, citraconic acid, hymic acid, bi-cyclo-(2,2,2)octa-5-ene-2,3-dicarboxylic acid, 1,2,3,4,5,8,9,10-octahydronaphthalene-2,3-dicarboxylic acid, bi-cyclo(2,2,1)octa-7-ene-2,3,5,6-tetracarboxylic acid and 7-oxa-bicyclo(2,2,1)hepta-5-ene-2,3-dicarboxylic acid.

4. The fiber material as claimed in claim 1, wherein said copolymer contains carboxyl radicals in an amount of 0.2 to 6 milli equivalent/g.

5. The fiber material as claimed in claim 1, wherein said copolymer is in a mixture with at least one fiber-forming polymer.

6. The fiber material as claimed in claim 5, wherein said fiber-forming polymer is selected from polyolefin, polyester and polyamide polymers.

7. The fiber material as claimed in claim 6, wherein in said mixture of copolymer with said polyester polymer, said copolymer is in an amount of 100 parts by weight or less based on 100 parts by weight of said polyester polymer.

8. The fiber material as claimed in claim 1, wherein the fine copper particles have a size of 50 mesh or smaller.

9. The fiber material as claimed in claim 1, wherein the fine copper particles are in the form of dispersoids dispersed in said second thermoplastic polymer material.

10. The fiber material as claimed in claim 9, wherein said second thermoplastic polymer material comprises at least one polymer selected from polyester, polyamide and polyolefin polymers.

11. The fiber material as claimed in claim 1, wherein the first and second fibers are blended in a ratio of from 90:10 to 50:50 by weight.

12. The fiber material as claimed in claim 1, wherein the first thermoplastic polymer is selected from polyester polymers having a melting temperature of 170° C. or more.

13. The fiber material as claimed in claim 1, wherein each of the first fibers is a composite fiber consisting of at least one deodorant filamentary constituent consisting of the deodorant material and at least one support filamentary constituent consisting of said first thermoplastic polymer, said deodorant filamentary constituent and said support filamentary constituent being bonded to each other and extending substantially in parallel to the longitudinal axis of the first-fiber and the deodorant filamentary constituent forming at least one portion of the periphery of the first fiber.

14. The fiber material as claimed in claim 13, wherein said composite fiber is a core-in-sheath structure in which the core is formed by the support filamentary constituent and the sheath is formed by the deodorant filamentary constituent and covers the core.

15. The fiber material as claimed in claim 13, wherein, in said composite fiber the support filamentary constituent and the deodorant filamentary constituent are bonded to each other in a bimetal structure in which the support filamentary constituent and the deodorant filamentary constituent extend in a side-by-side relationship to each other.

16. The fiber material as claimed in claim 1, wherein the first fibers contain said copolymer in an amount of 10% to 80% based on the weight of the first fibers.

17. The fiber material as claimed in claim 1, wherein said second thermoplastic polymer in the second fibers is selected from polyolefin polymers.

18. The fiber material as claimed in claim 1, wherein the anti-fungus material is distributed in an amount of 5% by weight or more in at least the peripheral surface portion of the second fibers.

19. The fiber material as claimed in claim 1, wherein the anti-fungus material is evenly distributed throughout the second fibers.

20. The fiber material as claimed in claim 1, wherein the second fibers have an irregular non-circular cross-sectional profile.

21. The fiber material as claimed in claim 1, wherein the second fibers are of a thick-and-thin type and have a cross-sectional area varying along the longitudinal axis thereof.

22. The fiber material as claimed in claim 1 wherein the first fiber is at least one copolymer of ethylene with at least one type of comonomer selected from ethylenically unsaturated carboxylic acids and anhydrides thereof.

* * * * *